US005996523A

United States Patent [19]

Fox

[11] Patent Number: 5,996,523

[45] Date of Patent: Dec. 7, 1999

[54] HYDRAULIC OSCILLATOR

[75] Inventor: Anton F. Fox, Mississauga, Canada

[73] Assignee: Damir Anton Fox, Oakville, Canada

[21] Appl. No.: 09/070,918

[22] Filed: May 4, 1998

[51] Int. Cl.[6] ..... B63H 25/22

[52] U.S. Cl. ..... 114/150; 92/120

[58] Field of Search ..... 114/150; 92/120, 92/121, 125, 129

[56] References Cited

U.S. PATENT DOCUMENTS 627,217 6/1899 Thew .
2,608,060 8/1952 Smith ..... 114/150
3,446,120 5/1969 Sneen .
3,731,597 5/1973 Payne .
3,750,535 8/1973 Higuchi .
4,982,680 1/1991 Hildre .

*Primary Examiner*—Stephen Avila
*Attorney, Agent, or Firm*—Eugene J. A. Gierczak

[57] ABSTRACT

A hydraulic oscillator having a stator defining an axis of rotation; rotor means; annular-shaped operating chamber between said stator and said rotor; rotary piston associated with said rotor means and disposed within said operating chamber for rotation about said axis of rotation of said stator.

19 Claims, 7 Drawing Sheets

HYDRAULIC OSCILLATOR

FIELD OF INVENTION

This invention relates generally to an hydraulic oscillator and in particular relates to an oscillating fluid driven actuator in bulk material handling systems, including improved sealing means.

BACKGROUND OF INVENTION

Motion converting apparatus or devices are used in a wide variety of environments. In particular, oscillating fluid-driven actuators can be used when a device is required to impart rotational force to another member. Such oscillating fluid-driven actuator can be manufactured in a variety of sizes depending on their application.

These actuators are ideal, although not limited to, equipment that requires high torque to rotate, such as for example bulk material handling systems. Hydraulic oscillators are utilized at mining sites that use large conveyer booms to load silos, trucks, trains or ships. The rotation of the boom is essential for the efficient positioning and loading and unloading of the material.

Oscillating fluid-driven actuators can be located at one end of the boom and can be rotationally driven about an axis to locate the conveyor boom at the desired location. Rotational movement of these oscillators is generally accomplished by rotational movement of a piston within an annular chamber. Trunnion hubs have been added to the actuator to permit vertical movement of the boom.

Oscillating fluid-driven actuators may be secured to land, on ships or other vehicles, or the like. Generally speaking oscillating fluid-driven actuators that have been secured to ships having large conveyor booms in their bulk material handling systems also utilize rack and pinion arrangements with the actuators when rotating the boom as such heavy output booms require high torque to rotate the booms during operation.

However, actuators having rack and pinion arrangements require large surface areas and therefore restrict the ships capacity due to size and space limitations of the deck covers. Such deck covers are required to be opened for loading, yet the size of the covers is limited by the external turning dimensions of the actuator due to its close proximity to the deck. The loading capacity of the ship may be increased by reducing the turning radius of the equipment.

Conventional ship steering can also be accomplished by rack and pinion structure or hydraulic cylinders. These units require hydraulic induced force. In such applications, the oscillator is fixed while allowing the internal pin or shaft to rotate about an axis which accordingly is attached to the rudder giving the ship's steering capability.

Various devices have heretofore been designed incorporating the actuators generally described above. For example. U.S. Pat. No. 4,982,680 relates to an hydraulic wing actuator for turning movement of a spindle comprising a lower part fixed to the ship hull and an upper part secured to the lower part and which together define a substantially torus shaped guiding path.

Moreover, U.S. Pat. No. 3,446,120 relates to an oscillating fluid-driven actuator having an annular segment-shaped piston slidable mounted in an annular segment-shaped chamber. The piston is integrally formed with an arm and a hub which in turn is operatively connected to a rotary shaft. A fitting plate carries a sealing member at one end or both ends of the piston and is connected to the piston to allow the plate radial movement on the pistons, whereby the sealing member is maintained in central bearing engagement with the chamber.

Furthermore, U.S. Pat. No. 3,731,597 illustrates another rotary actuator.

It is an object of this invention to provide an improved oscillating fluid-driven actuator. Furthermore, it is an object of this invention to provide a oscillating fluid-driven actuator having improved turning characteristics when utilized on ships.

Another difficulty experienced by prior art actuators resides in the leaking characteristics experienced by the fluid mechanisms utilized in the high pressure fluid systems. Many of the prior art actuators include sealing structure in the corners of an annular chamber which are difficult to accurately manufacture and assemble, and therefore eventually leak or ultimately fail in operation. Various attempts have been made to improve such seals. For example, U.S. Pat. No. 3,750,535 relates to a rotary actuator having seal material of synthetic resin which is provided in the internal periphery of the cylinder and the shaft. However, leaking of the seals still plague actuators manufactured in accordance with present standards.

It is a further object of this invention to provide an improved sealing structure when utilized with the actuator described herein.

SUMMARY OF THE INVENTION

It is an aspect of this invention to provide a hydraulic oscillator having a stator defining an axis of rotation; rotor means; annular-shaped operating chamber between said stator and said rotor; rotary piston associated with said rotor means and disposed within said operating chamber for rotation about said axis of rotation of said stator.

It is another aspect of the invention to provide an oscillating fluid driven actuator comprising a king pin defining an axis of rotation; a bushing fixedly secured to said king pin; a fixed piston fixedly secured to said bushing; a rotor means adapted to rotate about said axis of rotation of said king pin; an annular shaped operating chamber between said rotor means and, said king pin, and said fixed piston; a rotary piston fixedly secured to said rotor means, said rotary piston adapted for rotational movement within said operating chamber to define a first variable piston chamber and a second variable piston chamber; fluid pressure means communicating with said first and second variable piston chamber means for applying pressure to said rotary piston for moving said rotary piston and said rotor housing about said axis of rotation of said king pin.

These and other aspects of this invention shall now be described in relation to the following drawings.

BEST MODE FOR CARRYING OUT THE INVENTION

Figure 1:
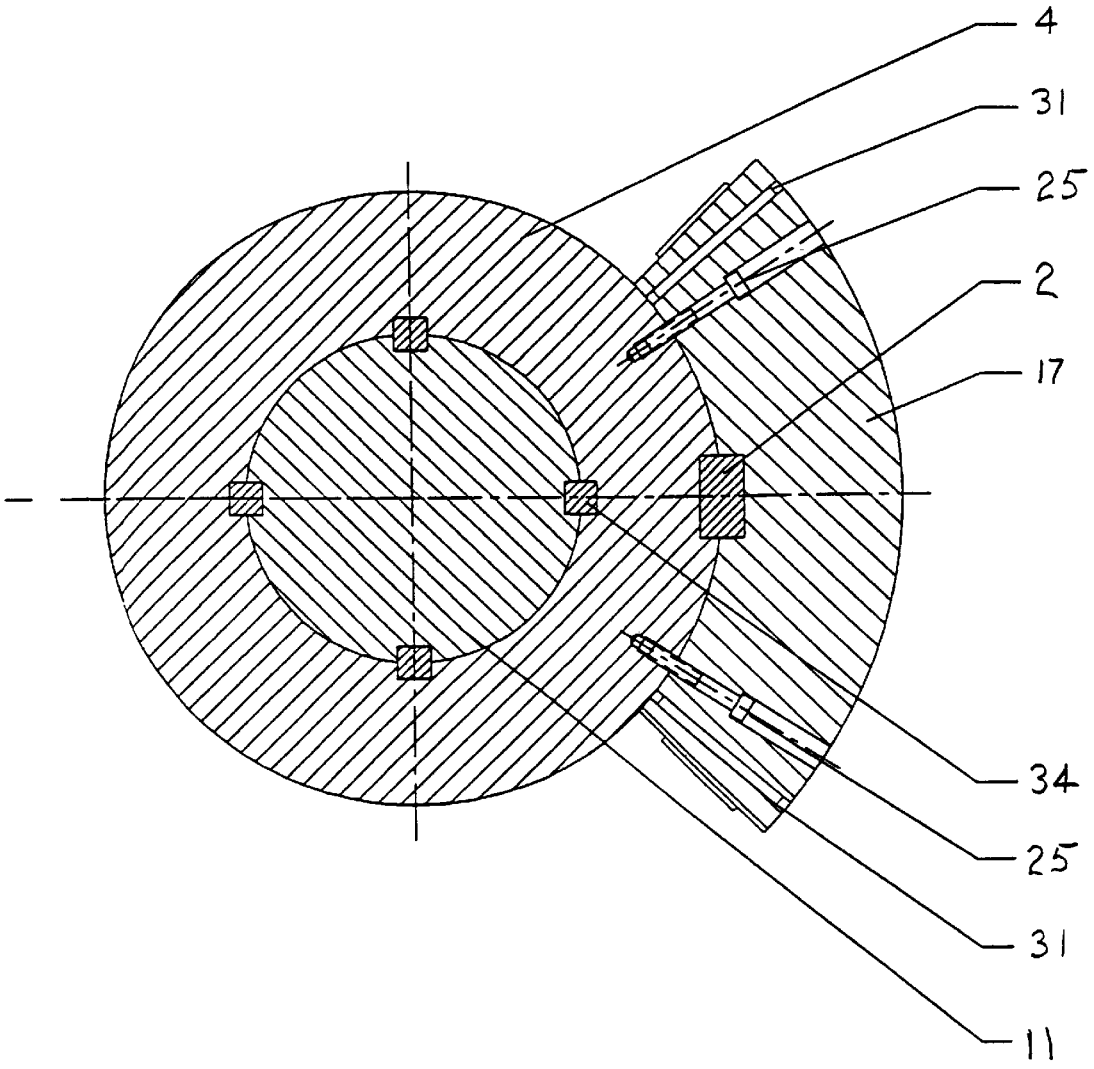
FIG. 1 is a top plan view of the king pin assembly.

In the description which follows, like parts are marked throughout the specification and the drawings with the same respective reference numerals. The drawings are not necessarily to scale and in some instances proportions may have been exaggerated in order to more clearly depict certain features of the invention.

FIG. 1 illustrates one assembly which has a shaft or king pin 11 having an axis of rotation 40 best illustrated in FIG. 4.

The shaft or king pin 11 includes king pin keys 34 which are appropriately machined so as to fixedly retain a bushing or inner king pin bushing 4. A piston 17 is keyed to the bushing 4 by means of a holding key 2. The piston 17 is also secured to the bushing 4 by means of piston bolts 25. The piston 17 is assembled with seals 31 to prevent oil bypass from the pressure it is designed for.

In one embodiment the king pin 11 is secured to a base, for example the base of a ship, by any standard industrial means such as bolting, welding or chalked fast to ensure rigidity and position. The king pin 11 is manufactured to have grooves to accept keys 34 for fitting the inner king pin bushing 4. Alternatively, splines or other attachment means can be used. In other words, the piston 17 is fixedly secured to the bushing 4 which in turn is fixedly secured to the shaft or king pin 11.

The keys 2 on the piston 17 and inner king pin bushing 4 are grooved out in such a manner that the king grooves do not run over the static sealing surface of the housing.

Figure 2:
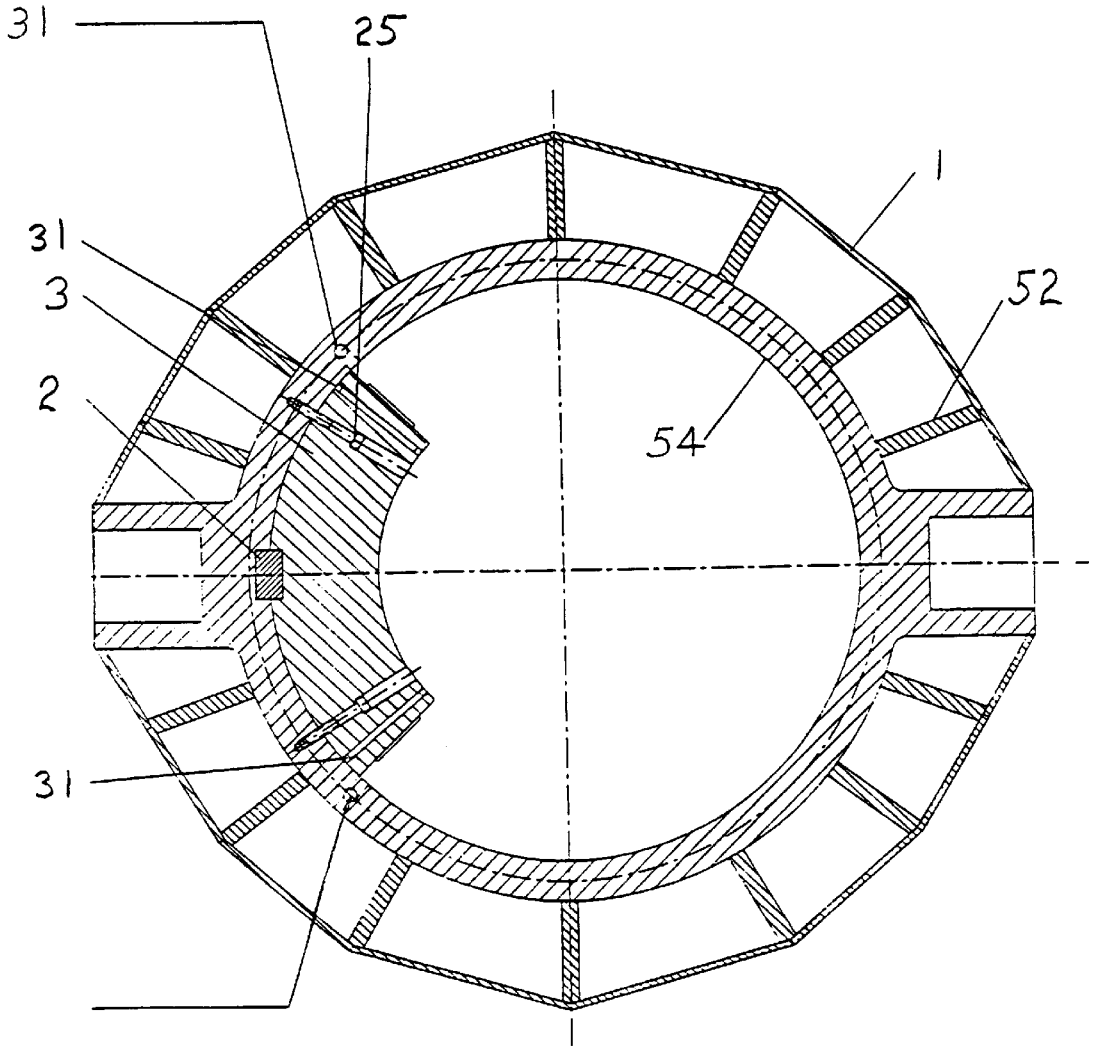
FIG. 2 is a top plan view of the outer rotor assembly.

FIG. 2 illustrates the outer rotary assembly and includes an outer rotor 1 having stiffening ribs 52 and furthermore includes a circular bore 54. The outer rotary assembly 1 also includes a holding key 2 which is adapted to be keyed to another piston 3. The piston 3 is secured to outer rotor 1 by means of the key 2 as well as piston bolts 25. The piston 3 also includes seals 31 to prevent oil by-pass for the pressures it is designed for.

Figure 3:
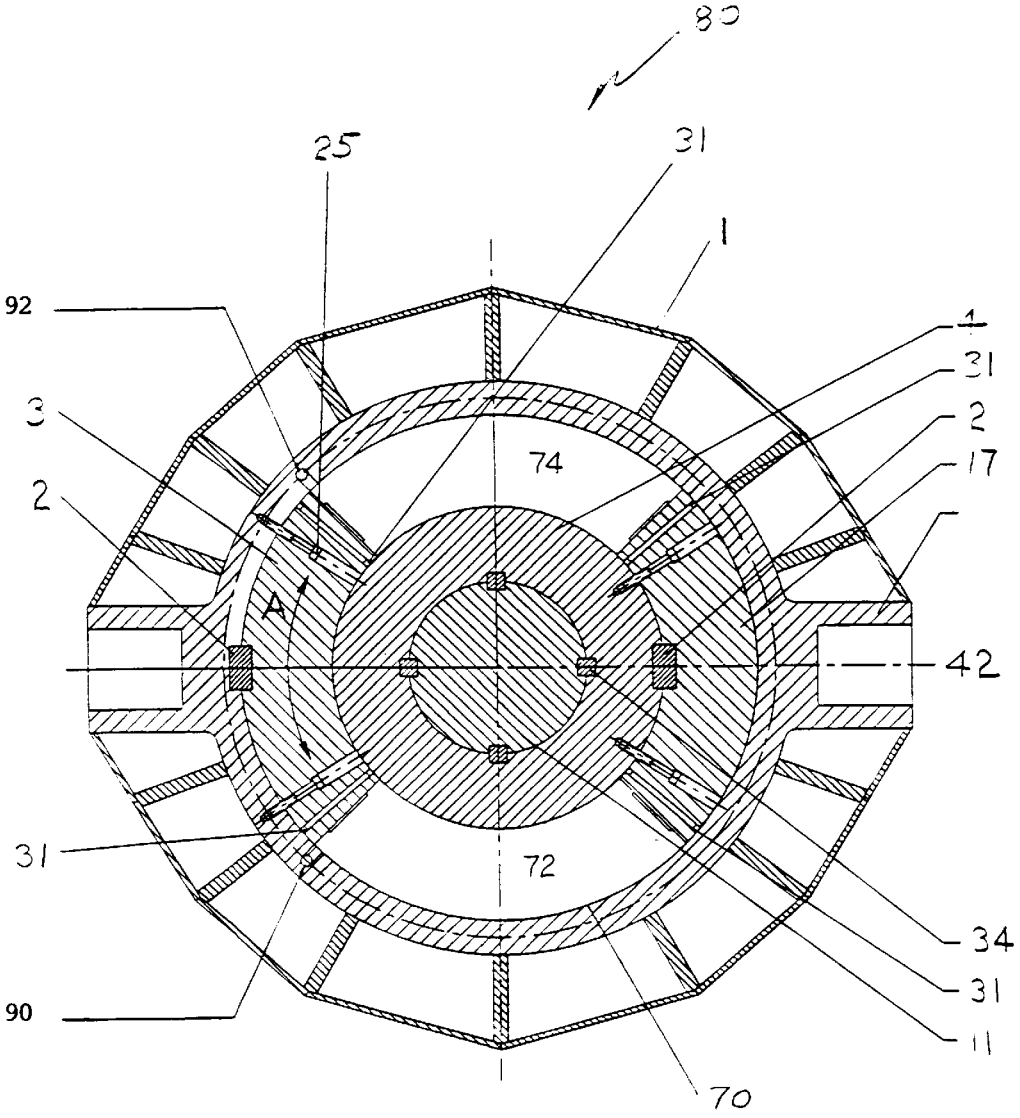
FIG. 3 is a cross-sectional view of the hydraulic oscillator taken along the line C—C of FIG. 4 where said outer rotor housing rotates about the king pin.

FIG. 3 illustrates one embodiment of the invention whereby the king pin assembly of FIG. 1 is assembled within the outer rotary assembly of FIG. 2.

Figure 6:
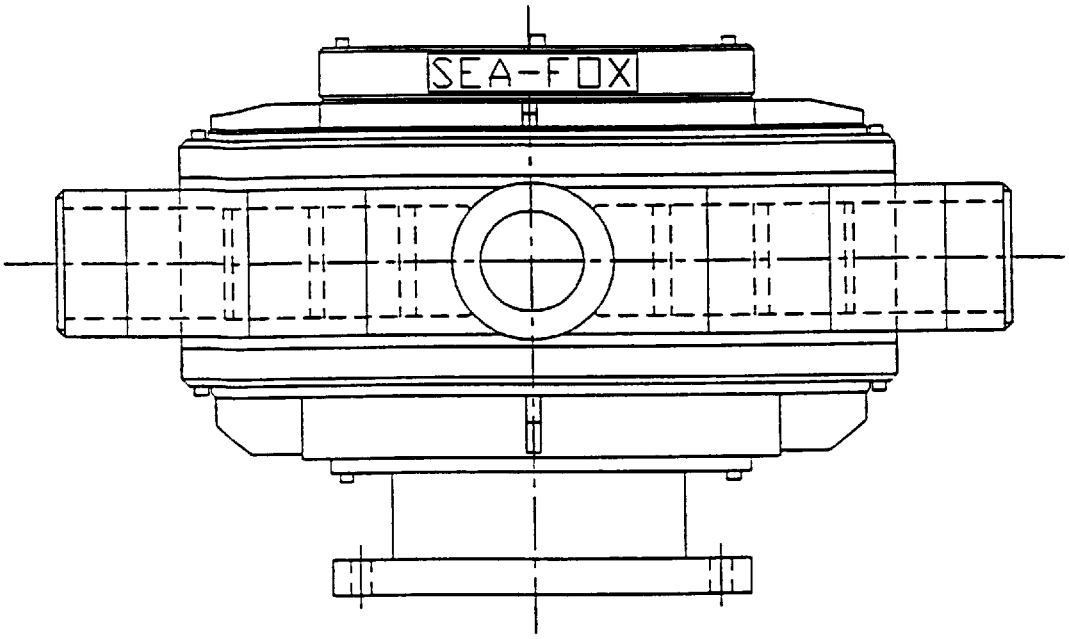
FIG. 6 is a side elevational view of said actuator.
Figure 7:
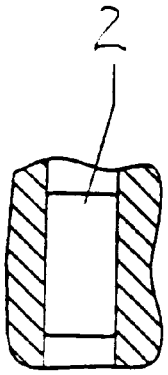
FIG. 7 is a partial cross-sectional view taken along the lines D—D of FIG. 4.

FIG. 3 illustrates one embodiment of the invention where the shaft or king pin 11, bushing 4 and piston 17 are fixed and not adapted for rotation. In other words, FIG. 3 can illustrate an embodiment where the actuator 80 is secured to the hull of the ship as shown in FIG. 6. In other words, the shaft or king pin 11, bushing 4, and piston 17 define a stator. The rotor 1 as shown in FIG. 3 as well as the piston 3 are adapted for rotational movement about the axis 40. In other words, the piston 3 shown in FIG. 3 is a rotary piston.

An annular-shaped operating chamber 70 is between the rotor 1 and king pin 11. In particular the annular-shaped operating chamber 70 as shown in FIG. 3 is disposed between the outer rotor 1 and bushing 4. The annular-shaped operating chamber 70 terminates at either ends of the fixed piston 17 as shown in FIG. 3. The rotary piston 3 is fixedly secured to the outer rotor housing 1 and adapted for rotational movement within the operating chamber 70 so as to define a first variable piston chamber 72 and a second variable piston chamber 74. Fluid pressure means communicates with the first and second piston chamber 72 and 74 by means of feed inlet lines 90 and 92 for selectively expanding or contracting the piston chamber 72 and 74 thereby applying pressure to the ends of the rotary piston 3 causing the rotary piston to rotate about the axis of rotation 11 along direction A as shown in FIG. 3.

The outer rotary housing 1 also includes trunnion means 94 which are adapted to be secured to a boom (not shown) thereby permitting the boom to rotate about a second axis of rotation 42 so as to cause the boom to be vertically moved.

Figure 5:
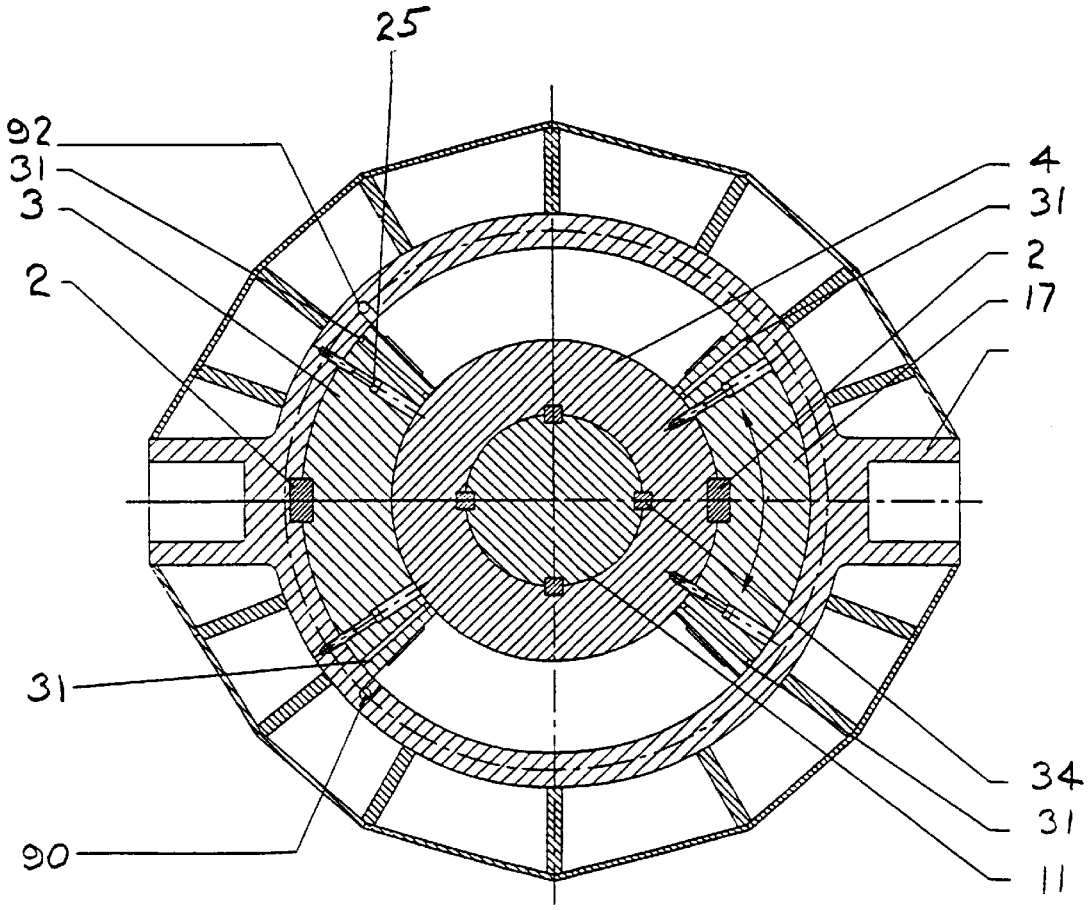
FIG. 5 is a cross-sectional view taken along the line C—C of FIG. 4 where said king pin rotates.

FIG. 5 shows another embodiment of the invention whereby the parts are similar to that shown in FIG. 3 except that the outer rotor 1 is fixedly secured so that the stator comprises the outer rotor 1 and piston 3 while the shaft or king pin 11, bushing 4 and piston 17 are adapted for rotational movement about the axis 11. In other words FIG. 5 illustrates an embodiment whereby the actuator 80 could be utilized on a ship in a rudder assembly whereby the rudder would be attached to the shaft 11. However, the invention when described in relation to the rudder is not limited thereby and serves only as an example of the invention which is being claimed as described herein.

Figures 4A, 4B:
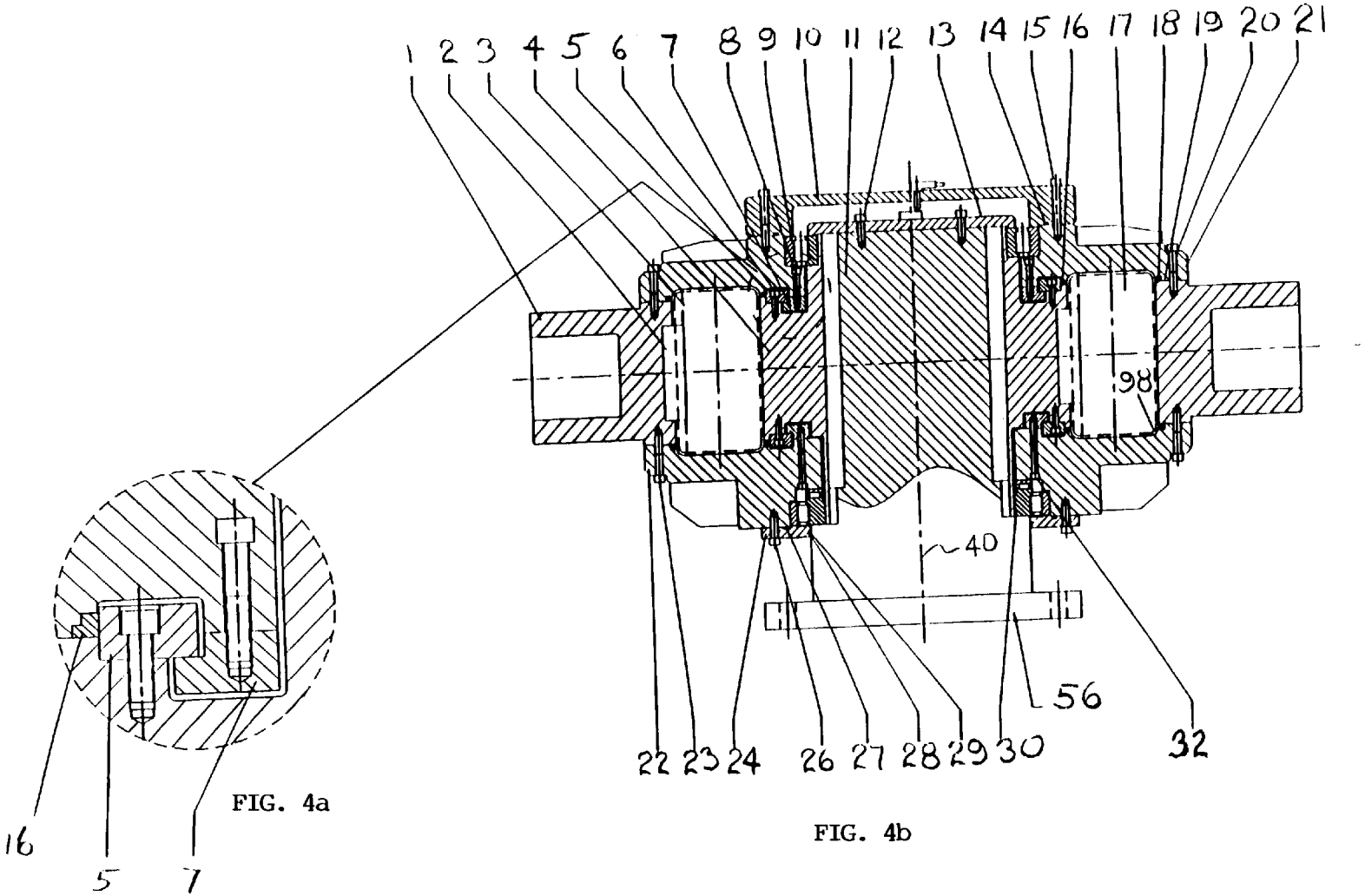
FIG. 4*a* is a cross-sectional view taken along the line E—E of FIG. 3.
FIG. 4*b* is an enlarged view of the section through 4*a*.

FIGS. 4A and 4B illustrate the invention herein in a side cross-sectional view and comprises the outer rotor housing 1, holding key 2 which is disposed between the outer rotor 1 and piston 3.

As described above the king pin bushing 4 is fixedly secured to the shaft 11. The actuator also includes top casing 21 which is fixedly secured to the outer rotor housing 1 by means of a top case bolt 20. Furthermore, the actuator 80 also includes a bottom casing 22 which is fixedly secured to the outer rotor housing 1 by means of bottom case bolt 23. The top casing 21, outer rotor housing 1 and bottom casing 22 are adapted for rotational movement about the axis 40 of the embodiment shown in FIG. 3. In other words, the outer rotor housing 1, top casing 21 and bottom casing 22 define a rotary means adapted to rotate about the axis of rotation 40 of the embodiment shown in FIG. 3.

The actuator 80 is fitted with bearing surfaces to reduce friction, maintain tolerances and prevent abrasion between sliding surfaces.

Key 2, king pin bushing 4, king pin retainer 13, piston 17, and king pin key 34, along with related seals and fasteners are the internal fixed assembly or stator on which the oscillator 80 rotates about. As best illustrated in FIG. 3 the rotary assembly includes outer rotor housing 1, key 2, piston 3, glider bearing 5, glider ring 7, bearing 9, top cover 10, top casing 21, bottom casing 22, bearing retainer 24 and axial bearing 30 along with related seals and fasteners.

In the embodiment shown in FIG. 3 radial and axial loads are transferred through the oscillator 80 to the king pin 11. Accordingly, a thrust bearing 30 is incorporated at the bottom of the actuator 80 to overcome the axial loading and two bearings are installed to overcome the radial forces. It is possible that one radial bearing may be used if the load is small enough to allow. The radial and axial bearing may also be incorporated as a single unit.

The trust bearing 30 is supported on the king pin 11 and is located in position with the bearing retainer 24. The bearing retainer seal 27 is utilized to minimize grease from flowing out and the wiper 28 is used to prevent dirt from flowing in. The bottom casing 22 rotates about this bearing and is connected by means of fasteners to the glider ring 7.

One of the difficulties of the prior art actuator resides in the design of sealing means particularly in the corners of the operating chambers. The annular-shaped operating chamber 70 as described herein present rounded corners 98 which are relatively easier to manufacture than in the case of designing and manufacturing square corners to accommodate seals therein. Seals designed to be located in such square corners will eventually leak. In the invention described herein the sealing means include a glider ring 7 and a glider bearing 5 presenting sealing surfaces remote from the corners 98. More particularly the glider ring 7 is comprised of rigid material sufficient to support the shear and bending stress created by the glider bearing 5. The glider bearing 5 is comprised of rigid bearing material sufficient to support the shear and bending stresses induced by the system. Moreover, the glider bearing is designed to have a low wear characteristic as this bearing will be subject to frictional loads. The glider bearing 7 is fixedly secured to the king pin bushing 4 by means of fasteners.

The attachment between the glider bearing 9 and the king pin 11 overlaps the attachment of the glider ring 7 to the bottom casing 22. This results in minimal deflection of the outer rotor housing while allowing rotary assembly to slide freely.

More particularly, the sliding sealing surfaces between the glider ring 7 and glider bearing 5 occur along a flat surface which is removed from the corners thereby facilitating manufacturing, improving ease of assembly, and improving wear characteristics of the seal. Prior art seals designed to be located within square corners have difficulty in maintaining long-lasting seal characteristics.

The glider bearing 5 is retained by glider bearing bolt 6 and glider ring is retained by glider ring bolt 8.

The bottom inner rotary seal 16 is installed to assemble with the bottom casing 22. The inner rotary seal 16 holds back pressure and prevents oil from being transferred to the outer parts and outside the system as a whole. Next the glider bearing 5 is installed and the glider ring 7 locks the glider bearings 5 into place using fasteners 32.

Thereafter the outer rotor seals 18 may be fitted into place. This outer rotor seal 18 is a static seal to contain oil leakage to the pressurized area.

The outer rotor housing 1 may be assembled and fitted to the bottom casing 22 using fasteners 23.

The rotary piston 3 can be loaded with seals 31 and the piston assembly is then fixed to the outer rotor housing 1 utilizing keys 2 and fasteners 25. Piston 3 rotates the outer rotor housing to a closed position and holds the oscillator stationary under load.

A sub-assembly of the king pin bushing 4 and the piston 17 is completed using key 2 and fasteners 25. Before this could be done seals 31 are inserted into place. Seals 31 are dynamically loaded during operation. Such seals 31 hold the oscillator in the desired position when the oscillator is running and when it is stationary. Such sub-assembly is the fixed portion of the oscillator that is to be fixed to the king pin and does not rotate. Such sub-assembly can now be installed on to the outer rotor.

The top glide ring 5 can be installed and clamped down with the top glide bearing 7. The top glide ring 5 is trapped in position by using fastener 6. Similarly, on the top casing 21 the glide bearing 9 and glider ring 7 overlap each other to lock the unit into vertical position and allow the outer rotary housing 1 to slide freely. The top inner and outer rotor seals 16 and 18, respectively, are installed. The seals 16 and 18 are static seals and contain the system pressure.

Thereafter the top cover can be assembled and fastened into place using fasteners 12. Then the top radial bearing 9 can be inserted into place.

The oscillator can then be slipped into position over the key pin 11 and the king pin bushing 4 can be keyed by means of keys 34 to the king pin 11.

Figure 8:
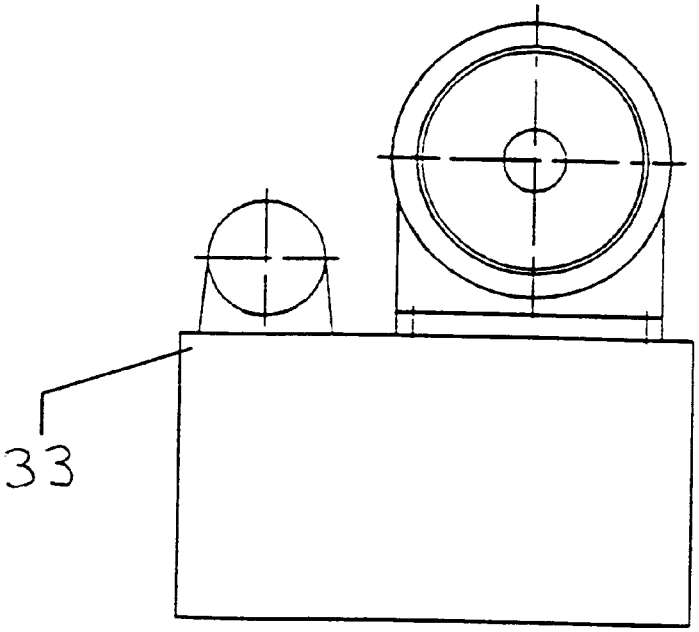
FIG. 8 is a side elevational view of the hydraulic power unit.

The oscillator 80 can be powered using a hydraulic power unit as shown in FIG. 8. Hydraulic oil is forced into a port 90 forcing the rotary piston to move about the stator. The oil in the opposite side of the piston is forced out port 92 and back to the tank. To reverse the direction, oil is forced into the port 92 and the piston will force oil out of port 90 and back to the tank. The oil is locked into position with the use of the counter-balance valves.

Furthermore, the actuator described herein includes a cover seal 14, top cover bolt 15, inner rotary seal 16, outer rotary seal 18, heat (case) seal 19, top case bolt 20, retainer bolt 26, king pin seal 29, piston seals 31, hydraulic power unit 33 and sensor positioner 35.

Moreover, the shaft or king pin 11 can include a base 56 having holes adapted to be secured to a surface such as a deck of a ship.

In the drawings shown, particularly between the stationary and moveable parts, seals are provided between the horizontal motion and the vertical seal. In other words, seals are provided in three dimensions between moving and stationary parts.

The actuator described herein has the following advantages over prior art devices, namely:

(a) increased torque capacity with less surface area;
(b) eliminate conventional rack and pinion assemblies;
(c) reduce manufacturing costs;
(d) increase efficiency; and
(e) virtually eliminate back lash created on rack and pinion system.

Moreover, the inner rotational ring absorbs vertical deflection which is contained with glide bearing five supports.

Various embodiments of the invention have now been described in detail. Since changes in and/or additions to the above-described best mode may be made without departing from the nature, spirit or scope of the invention, the invention is not to be limited to said details.

Although the preferred embodiment as well as the operation and use have been specifically described in relation to the drawings, it should be understood that variations in the preferred embodiment could be achieved by a person skilled in the trade without departing from the spirit of the invention as claimed herein.

I claim:

1. A hydraulic oscillator having (a) a stator defining an axis of rotation;
(b) rotor means including:
  (i) a top casing;
  (ii) a bottom casing;
  (iii) an outer rotor casing;
(c) annular-shaped operating chamber between said stator and said rotor;
(d) rotary piston associated with said rotor means and disposed within said operating chamber for rotation about said axis of rotation of said stator.

2. A hydraulic oscillator as claimed in claim 1 wherein said stator comprises a shaft defining an axis of rotation, and a fixed piston associated with said shaft, whereby said rotary piston rotates about said shaft between a first position contacting said fixed piston and a second position contacting said fixed piston.

3. A hydraulic oscillator as claimed in claim 2 further including a bushing fixedly secured to said shaft and said fixed position fixedly secured to said bushing.

4. A hydraulic oscillator having (a) a stator including a shaft defining an axis of rotation, and a fixed piston associated with said shaft;

(b) a bushing fixedly secured to said shaft and said fixed piston fixedly secured to said bushing;

(c) rotor means including:

(i) a top casing;

(ii) a bottom casing;

(iii) an outer rotor housing;

(d) annual-shaped operating chamber between said stator and said rotor means;

(e) rotary piston associated with said rotor means and disposed within said operating chamber for rotation about said axis of rotation of said stator whereby said rotary piston rotates about said shaft between a first piston contacting said fixed piston and a second piston contacting said fixed piston.

5. A hydraulic oscillator as claimed in claim 4 wherein said annular-shaped operating chamber is disposed between said top casing, bottom casing, outer rotor housing, and said bushing.

6. A hydraulic oscillator as claimed in claim 5 wherein said operating chamber includes rounded corners, and further includes sealing means remote from said corners.

7. A hydraulic oscillator as claimed in claim 6 wherein said rotor housing includes trunnion means rotatable about a second axis of rotation.

8. A hydraulic oscillator as claimed in claim 7 wherein said sealing means includes a glider bearing fixedly secured to said bushing and a glider ring fixedly secured to said top casing for relative sealing movement with said glider bearing.

9. An oscillating fluid driven actuator comprising (a) a king pin defining an axis of rotation;

(b) a bushing fixedly secured to said king pin;

(c) a fixed piston fixedly secured to said bushing;

(d) a rotor means adapted to rotate about said axis of rotation of said king pin;

(e) an annular shaped operating chamber between said rotor means and, said king pin, and said fixed piston;

(f) a rotary piston fixedly secured to said rotor means, said rotary piston adapted for rotational movement within said operating chamber to define a first variable piston chamber and a second variable piston chamber;

(g) fluid pressure means communicating with said first and second variable piston chamber means for applying pressure to said rotary piston for moving said rotary piston and said rotor housing about said axis of rotation of said king pin.

10. An actuator as claimed in claim 9 wherein said king pin is secured to the deck of a ship.

11. An actuator as claimed in claim 9 wherein said rotary means includes a top casing, bottom casing, and rotary housing and said annular shaped operating chamber is disposed between said top casing, bottom casing, said rotor housing, and said bushing.

12. An actuator as claimed in claim 10 wherein said operating chamber includes rounded corners and further includes sealing means remote from said corners.

13. An actuator as claimed in claim 11 wherein said sealing means includes bearing means fixedly secured to said bushing, and a ring fixedly secured to said top casing for relative sealing movement with said bearing.

14. An actuator as claimed in claim 12 wherein rotor housing includes trunnion means rotatable about a second axis of rotation.

15. An actuator as claimed in claim 12 wherein said boom is secured to said rotor housing.

16. An actuator as claimed in claim 14 wherein said boom is adapted for rotation about said axis of rotation about said king pin, and adapted for vertical movement about said second axis of rotation.

17. An actuator as claimed in claim 15 wherein said bushing is keyed to said king pin.

18. An actuator as claimed in claim 16 wherein said rotary piston is keyed to said outer rotor.

19. An actuator as claimed in claim 17 wherein said fixed piston is keyed to said bushing.

* * * * *